US007880103B2

(12) United States Patent
Bharaj et al.

(10) Patent No.: US 7,880,103 B2
(45) Date of Patent: Feb. 1, 2011

(54) MICROSWITCH WITH PUSH-IN WIRE CONNECTOR

(75) Inventors: Maninder S. Bharaj, Scarborough (CA); Richard C. Tsou, Etobicoke (CA)

(73) Assignee: Honeywell International Inc., Morristown, NJ (US)

( * ) Notice: Subject to any disclaimer, the term of this patent is extended or adjusted under 35 U.S.C. 154(b) by 755 days.

(21) Appl. No.: 11/837,794

(22) Filed: Aug. 13, 2007

(65) Prior Publication Data

US 2009/0045040 A1 Feb. 19, 2009

(51) Int. Cl.
*H01H 1/00* (2006.01)

(52) U.S. Cl. ..... 200/284

(58) Field of Classification Search ..... 200/284, 200/52 R, 302.1, 539, 11 J; 439/811, 188
See application file for complete search history.

(56) References Cited

U.S. PATENT DOCUMENTS

| | | | | |
|---|---|---|---|---|
| 2,586,892 | A * | 2/1952 | Weber et al. | 200/11 J |
| 2,720,634 | A | 1/1954 | Hart | |
| 4,006,323 | A * | 2/1977 | Nelson et al. | 200/284 |
| 4,190,750 | A | 2/1980 | Piber | |
| 4,306,126 | A * | 12/1981 | Howard | 200/52 R |
| 5,599,201 | A | 2/1997 | Sommer et al. | |
| 5,750,947 | A | 5/1998 | Rao et al. | |
| 5,855,492 | A | 1/1999 | Abe et al. | |
| 6,056,585 | A | 5/2000 | Hatakeyama et al. | |
| 6,712,641 | B2 | 3/2004 | Beege et al. | |
| 6,847,000 | B1 | 1/2005 | Marchini et al. | |
| 6,856,232 | B2 | 2/2005 | Chen | |
| 7,135,651 | B2 | 11/2006 | Lung | |
| 2001/0013466 | A1 | 8/2001 | Yanai et al. | |

FOREIGN PATENT DOCUMENTS

| | | |
|---|---|---|
| JP | 06-208813 A | 7/1994 |

(Continued)

OTHER PUBLICATIONS

DNA Group Inc., "Rotary Switches from DAN Group," 3 pp, Jan. 25, 2006.

(Continued)

*Primary Examiner*—Edwin A. Leon

(57) ABSTRACT

A microswitch with push-in wire connectors is provided. In one illustrative embodiment, the microswitch may include a plunger for activating the switch, a first stationary contact, a second stationary contact, a movable contact, and a snap-spring assembly reactive to the plunger for switching the movable contact between making electrical contact with the first stationary contact and making electrical contact with the second stationary contact. The microswitch may include a first push-in wire connector for electrically connecting an end of a first wire to the first stationary contact, a second push-in wire connector for electrically connecting an end of a second wire to the second stationary contact, and a third push-in wire connector for electrically connecting an end of a third wire to the movable contact. Alternatively, or in addition, the microswitch may include a housing that, when viewed from the first surface, may have a footprint that is generally rectangular in shape except for a first housing projection and a second housing projection that extend out from different sides of the housing. The first housing projection and the second housing projection may house first and second push-in wire connectors, as desired.

32 Claims, 7 Drawing Sheets

FOREIGN PATENT DOCUMENTS

| | | | |
|---|---|---|---|
| JP | 11-067014 | A | 3/1999 |
| KR | 20-19900001596 | | 1/1990 |
| KR | 10-19980042151 | | 8/1998 |

OTHER PUBLICATIONS

DNA Group Inc., "Trigger Switches from DNA Group," 3 pp, Jan. 25, 2006.
DNA Group Inc., "Snap Action Switches from DNA Group," 2 pp, Jan. 25, 2006.
Knisley, "Guidelines for wiring device application designs," EC&M, pp. 1-6, Jan. 25, 2006.
Honeywell, "Fan and Limit Controllers,", pp. 1-10, 1985.
Pancon, "Data Sheet Switch-Con," 2 pp, prior to Aug. 13, 2007.
Eaton, "Switch Training Manual,", pp. 1-25, prior to Aug. 13, 2007.
WAGO Innovative Connections, 1 page, prior to Aug. 13, 2007.
WAGO Innovative Connections, Item No. 256-401, "Modular PCB Terminal Block; 2 Solder Pins/Pole; 1 Pole; Pin Spacing 5/5.08 MM/0.2 In; Front-Entry; Cage Clamp Connection," 3 pp, prior to Aug. 13, 2007.
V5 Standard Construction, 1 page, prior to Aug. 13, 2007.

* cited by examiner

MICROSWITCH WITH PUSH-IN WIRE CONNECTOR

FIELD

The present invention generally relates to electrical switches, and more particularly, to microswitches with push-in wire connectors.

BACKGROUND

Microswitch devices are used in a wide variety of applications. Depending on the application, the microswitch devices may be simple on-off type switches, a normally open type switches, a normally closed type switches, or any other type of switches. In many cases, the microswitch devices include a housing that encloses the switching mechanism, and terminals that protrude out of the housing. The terminals are often of the screw terminal type, spade terminal type, or a tab terminal type.

During use, a microswitch device is often mounted to a printed circuit board, a housing or some other object within a host device. Lead wires of the host device are then connected to the protruding terminals of the microswitch device. In many cases, the wire leads of the host device are screwed, soldered, welded, or otherwise attached to the terminals of the microswitch device. In some cases, a connector is first attached to the end of each wire lead, and the connector is slid on or otherwise attached to the protruding terminals of the microswitch device. In addition, an insulation barrier is also often provided over or around the connection between the protruding terminals and the lead wires to reduce the chance of a short or other interference caused by the connection. As can be appreciated, the time and cost of connecting the lead wires of the host device to a microswitch device can be significant. Also, if the connection is not properly made, the reliability of the host device may be reduced. Therefore, what would be desirable is a microswitch device that can be assembled into a host device relatively quickly and reliably.

SUMMARY

The following summary is provided to facilitate an understanding of some of the innovative features unique to the present invention and is not intended to be a full description. A full appreciation of the invention can be gained by taking the entire specification, claims, drawings, and abstract as a whole.

The present invention generally relates to electrical switches, and more particularly, to switches with push-in wire connectors. In one illustrative embodiment, a switch is provided that includes a housing having a first surface, a second surface opposing the first surface, and side surfaces extending between the first surface and the second surface. The housing, when viewed from the first surface, may have a footprint that is generally rectangular in shape except for a first housing projection that extends out from a side of the housing, but this is not required. A second housing projection may also extend out from a side of the housing.

The first housing projection may have a first wire receiving opening, and the second housing projection may have a second wire receiving opening. A first spring clamp may be provided inside the housing and adjacent to the first wire receiving opening for receiving and clamping an end of a stripped lead wire that is pushed-in through the first wire receiving opening. Likewise, a second spring clamp may be provided inside the housing and adjacent to the second wire receiving opening for receiving and clamping an end of another stripped lead wire that is pushed-in through the second wire receiving opening. In some cases, one or more other spring clamps may be provided inside the housing adjacent to yet other wire receiving openings for receiving and clamping an end of other stripped lead wires that are pushed-in through the corresponding wire receiving openings, if desired. The spring clamps, in cooperation with the housing, may form push-in wire connectors to ease assembly and improve reliably of the wire connections to the switch.

To activate the switch, a plunger may be provided. To switch the state of the switch, the plunger may be depressed. In some cases, and to keep the same footprint as a conventional microswitch device that includes protruding terminals that protrude out from the switch housing, one or more of the housing projections may extend out into the region that would otherwise be consumed by the protruding terminals.

In some embodiments, a snap acting switch may be provided that includes a housing, a plunger, a stationary anchor, a first stationary contact, a second stationary contact, and a movable contact. The first stationary contact may be a normally open contact and the second stationary contact may be a normally closed contact, but this is not required.

The illustrative switch may include a snap-spring assembly reactive to the plunger. The snap-spring assembly may be coupled to the stationary anchor to form a snap-spring-anchor assembly that has a central spring member loaded into an axial compression and persuaded to bend to form a switch mechanism in which the movable contact is responsive to an actuating force derived from the plunger via the snap-spring assembly to move the movable contact between making electrical contact with the first stationary contact and making electrical contact with the second stationary contact.

In some cases, the switch may include a first conductive terminal member electrically coupled to the first stationary contact. The first conductive terminal member may extend from the first stationary contact to a first cavity inside the housing. The first cavity may have a first hole extending out through the housing, and may be adapted to receive an end of a first wire lead for connection to the first conductive terminal member. The first conductive terminal member may not extend outside of the housing.

The illustrative switch may also include a second conductive terminal member electrically coupled to the second stationary contact. The second conductive terminal member may extend from the second stationary contact to a second cavity inside the housing. The second cavity may have a second hole extending out through the housing, and may be adapted to receive an end of a second wire lead for connection to the second conductive terminal member. The second conductive terminal member may also not extend outside of the housing.

When desired, the illustrative switch may further include a third conductive terminal member electrically coupled to the movable contact. The third conductive terminal member may extend to a third cavity inside the housing, wherein the third cavity has a third hole extending out through the housing that is adapted to receive an end of a third wire lead for connection to the third conductive terminal member. The third conductive terminal member may also not extend outside of the housing.

DESCRIPTION

The invention may be more completely understood in consideration of the following detailed description of various illustrative embodiments of the invention in connection with the accompanying drawings, in which.

DETAILED DESCRIPTION

Figure 1:
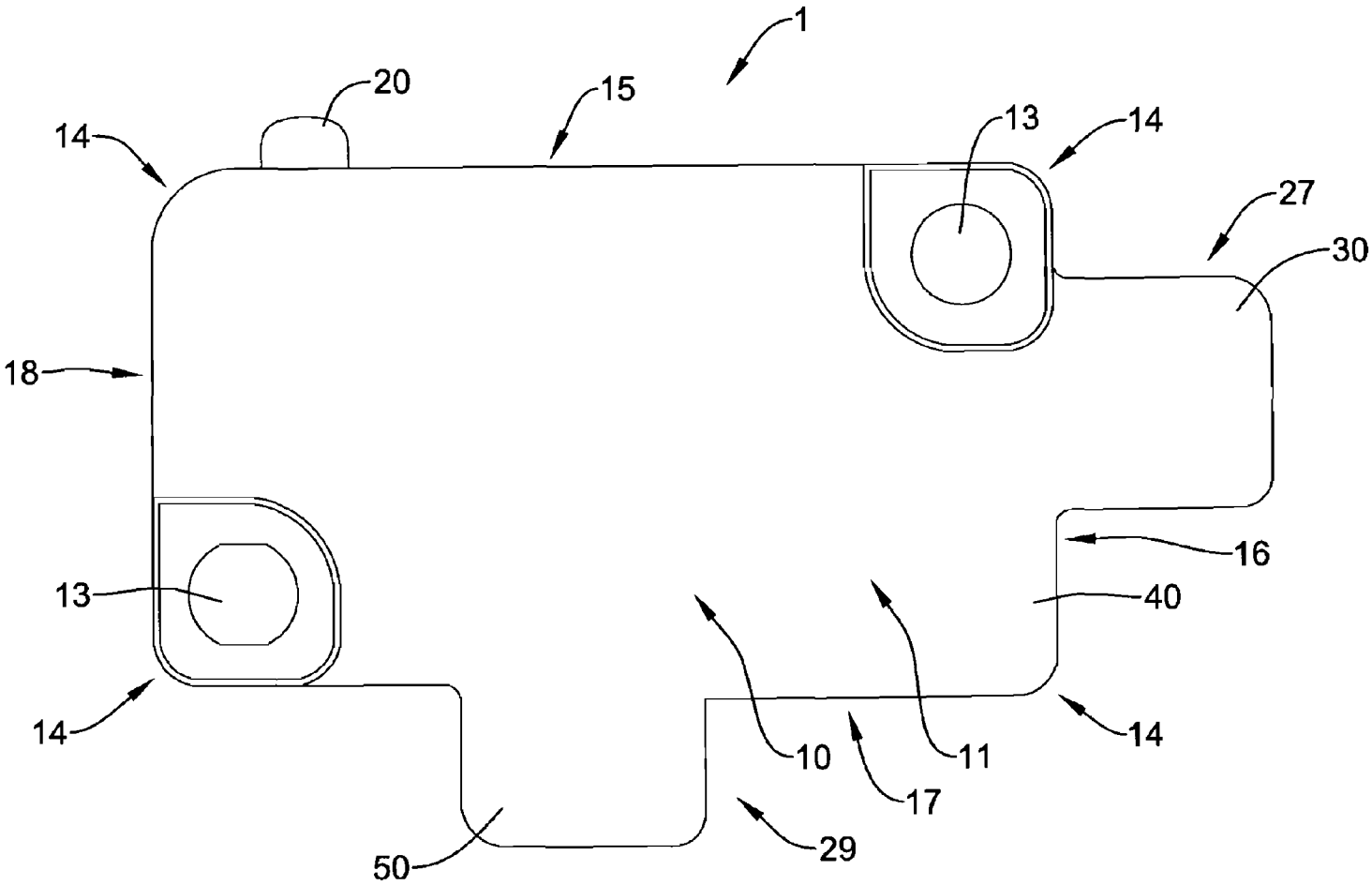
FIG. 1 is a head on view of a microswitch in accordance with one illustrative embodiment of the present invention.

The following description should be read with reference to the drawings wherein like reference numerals indicate like elements throughout the several views. The detailed description and drawings show several embodiments which are meant to be illustrative of the claimed invention.

FIG. 1 is a head on view of a microswitch in accordance with one illustrative embodiment of the present invention. In the illustrative embodiment, the microswitch 1 includes a body or housing 10 that is adapted to hold the switch mechanism. The housing 10 can include a first surface 11, a second surface (shown as 12 in FIGS. 4-5) opposing the first surface 11, and one or more side surfaces 15, 16, 17, and 18 extending between the first surface 11 and the second surface 12. In the illustrative embodiment, the first surface 11 may be a front surface of the housing 10, the second surface 12 may be a back surface of the housing 10, and the one or more side surfaces may be a top surface 15 of the housing 10, a bottom surface 17 of the housing 10, a left surface 18 of the housing 10, and a right surface 16 of the housing 10. It should be appreciated that the terms "front", "back", "top", "bottom", "left" and "right" are used herein only as relative terms, and are not intended to be limiting in any way. That is, it should be recognized that depending on the orientation of the switch, the front, back, top, bottom, left and right may change.

As viewed from the front surface 11, the illustrative housing 10 may have a footprint that is generally rectangular in shape with the exception of a first housing projection 27 and a second housing projection 29. The term "generally rectangular" in shape is intended to include a shape that includes deviations from a perfect rectangle, such as rounded corners 39, mounting holes 13, recesses, etc. Also, the term "generally rectangular" is intended to include a square or other similar shape. In some cases, the generally rectangular footprint may be 3 inches or less by 2 inches or less, but this is not required. In one case, the generally rectangular footprint may be 1.2 inches or less by 0.66 inches or less. It should be appreciated that these are only illustrative dimensions, and that the dimensions of the generally rectangular footprint may be any suitable size, depending on the application.

In some cases, the first housing projection 27 may help define a normally closed terminal 30 of the microswitch 1, and the second housing projection 29 may define a common terminal 50 of the microswitch 1. In the illustrative embodiment, the first housing projection 27 for the normally closed terminal 30 may extend out from the right side 16 of the housing 10, and the second housing projection 29 for the common terminal 50 may extend out from the bottom side 17 of the housing 10. In some cases, the first housing projection 27 may be spaced downward from the top side 15 and upward from the bottom side 17 of the housing 10, but this is not required in all embodiments. Additionally, the second housing projection 29 may be spaced leftward from the right side 16 and rightward from the left side 18 of the housing 10, but again this is not required. As shown in FIG. 1, the second housing projection 29 may be positioned to extend out from at or near the center of the bottom side 17 of the housing 10.

In the illustrative embodiment shown in FIG. 1, the microswitch 1 may include a third conductive terminal, such as, a normally open terminal 40. However, in contrast to terminal 30 and terminal 50, the third conductive terminal 40 may be provided within the generally rectangular footprint of the housing 10, as shown. In some cases, however, the housing 10 may include a third housing projection (not shown) for the third conductive terminal 40, if desired.

In the illustrative embodiment of FIG. 1, the housing 10 may include a wire receiving opening (shown in FIGS. 2, 4, and 5) that extends through the housing 10 for each of the illustrative terminals 30, 40 and 50. The wire receiving openings may be sized and shaped to receive a stripped end of a lead wire, such as a lead wire from a host device as will be discussed in further detail below. Additionally, the housing 10 may include a wire release opening (shown in FIGS. 2, 3, and 4) for each of the illustrative terminals 30, 40 and 50. The wire release openings may help facilitate the release of the lead wire ends from the conductive terminals of the microswitch 1, if desired.

In the illustrative embodiment, the first housing projection 27 includes a right side, a top side, and a bottom side. In some cases, a first wire receiving opening 34 (shown in FIG. 4) may extend through the right side of the first housing projection 27. Furthermore, in some cases, the first housing projection 27 may include a first wire release opening 35 extending through the bottom side of the first housing projection 27, as shown. However, in other cases, the first wire release opening 34 may extend through the top side or the right side of the first housing projection, if desired.

In some cases, and as shown in FIG. 1, the second housing projection 29 may include a right side, a left side and a bottom side. In the illustrative embodiment, the second wire receiving opening 54 (shown in FIG. 5) may extend through the bottom side of the second housing projection 29, but this is not required. Furthermore, in some cases, the second housing projection 29 may include a second wire release opening 55 extending through the right side of the second housing projection 29, as shown. However, it is contemplated that the second wire release opening 55, which provided, may extend through the left side or the bottom side of the second housing projection 29, as desired.

In some cases, the housing 10 may include a third wire receiving opening 44 that extends through the right side 16 of the housing 10, adjacent to terminal 40. In some cases, the third wire receiving opening 44 may be situated between the first housing projection 27 and the bottom side 17 of the housing 10. However, in other cases, the third wire release opening 44, which provided, may extend through, for example, the bottom side 17 of the housing 10, if desired.

In some cases, and as shown in the illustrative embodiment of FIG. 1, the microswitch 1 may include one or more mounting holes 13 that extend through the housing 10 between the first surface 11 and the second surface 12. The illustrative mounting holes 13 may be used to secure the microswitch 1 to a printed circuit board, housing or other object of a host device. In the illustrative example, the microswitch 1 includes two mounting holes 13, with a first mounting hole 13 located in a bottom left quadrant of the housing 10, such as in the bottom left corner 14, and a second mounting hole 13 located in a top right quadrant of the housing 10, such as in the top right corner 14. It is contemplated, however, that the mounting holes 13, when provided, may be located at any suitable location, as desired.

The illustrative microswitch 1 also includes a plunger 20 extending through the top surface 15 of the housing 10. The plunger 20 is used to change the switching state of the microswitch 1. In the illustrative embodiment, the plunger 20 may be used to actuate the switch position of the microswitch 1 between connecting the common terminal 50 to the normally closed terminal 30 and the normally open terminal 40, as will be discussed in further detail below.

In some cases, the housing 10 may be formed from or include an electrically insulative material such as a plastic, ceramic or glass material. In some cases, the housing 10 may be formed from or include a plastic regrind, which, in some cases, may include a glass fill. However, it should be recognized that the housing 10 may be formed from any suitable material, using any suitable process, as desired.

In the illustrative embodiment, the housing 10 may serve many purposes for the microswitch 1. In some cases, the housing 10 may provide rigidity and support for the microswitch 1 to withstand the various operating conditions. In some cases, the housing 10 may help to prevent moisture from entering the microswitch 1 to help prevent corrosion or other destructive effects within the switch. Also, the housing 10 may provide increased electrical insulation for the conductive terminals 30, 40, and 50 of the microswitch 1 by encapsulating the terminals 30, 40, and 50.

Figure 2:
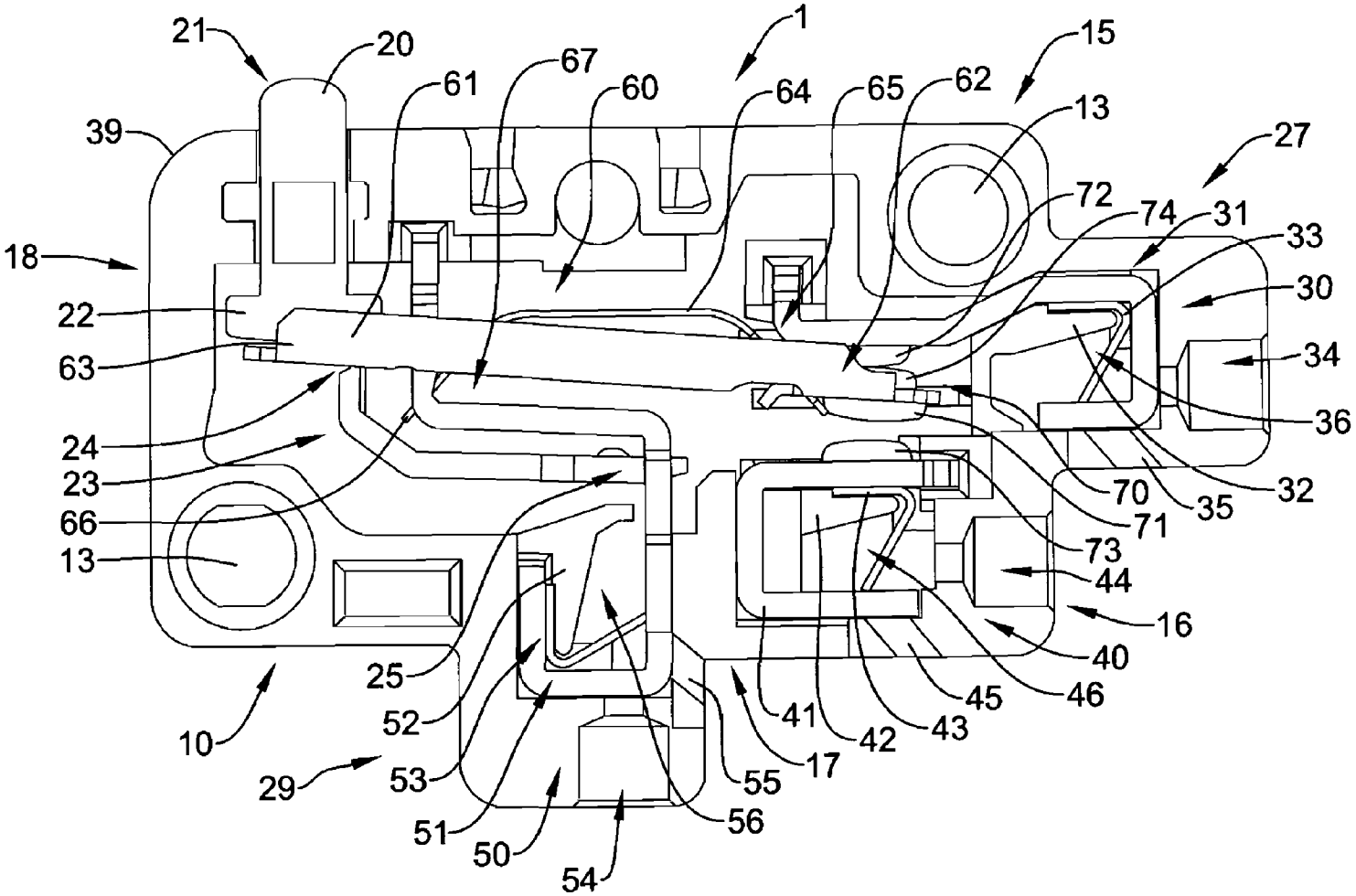
FIG. 2 is a head on view of the illustrative microswitch of FIG. 1, showing the inner components of the microswitch.

FIG. 2 is a head on view of the illustrative microswitch of FIG. 1, showing the inner components of the microswitch. In the illustrative embodiment, the microswitch 1 includes a normally closed terminal 30, a normally open terminal 40, and a common terminal 50. A plunger 20 is provided to actuate a snap-spring assembly 60 that is used to switch the microswitch 1 between connecting the common terminal 50 the normally closed terminal 30 and the normally open terminal 40. The terminals 30, 40, and 50 may include push-in wire connectors for electrically connecting an end of a lead wire to the terminals 30, 40, and 50, as further described herein.

In the illustrative embodiment, the normally closed terminal 30 can include a first conductive terminal member 31 that is electrically coupled to a first stationary contact 72. In some cases, the first conductive terminal member 31 can extend at least from the first stationary contact 72 to a first cavity 36 inside the housing 10. In some cases, the end of the first conductive terminal member 31 that extends into the first cavity 36 may be generally U-shaped, as shown. In some cases, the U-shaped first end of the first conductive terminal member 31 may have two substantially parallel extending portions with an interconnecting portion extending between the two substantially parallel extending portions. A slot or other aperture may be provided through the interconnecting portion, substantially aligned with the wire receiving opening 34, to permit an end of a lead wire to pass therethrough.

As shown in FIG. 2, the normally closed terminal 30 may include a first spring clip 33. The first spring clip 33 may be situated in or adjacent to the U-shaped first end of the first conductive terminal member 31. In some cases, a clip mounting mechanism 32 can be provided to secure the spring clip 33 relative to the first conductive terminal member 31. In some cases, the clip mounting mechanism 32 may be part of the housing 10. However, it is contemplated that any suitable method of securing the first spring clip 33 relative to the first conductive terminal member 31 may be used, as desired.

The first wire receiving opening 34 discussed above may extend through the housing 10 and into the first cavity 36. The first wire receiving opening 34 can be sized to receive an end of a first lead wire for connection to the first conductive terminal member 31. In some cases, the first wire receiving opening 34 may have a depth of at least 0.10 inches or at least 0.25 inches. However, it is contemplated that any suitable depth may be used, as desired. The depth of the first wire receiving opening 34 may help determine the insulative characteristics of the housing in or around the first wire receiving opening 34.

In some cases, at least one of the two substantially parallel extending portions of the first conductive terminal member 31 may include a first wire release opening, and the housing 10 may include a corresponding first wire release opening 35 for allowing a force to be applied to the first spring clip 33 to release the end of the first lead wire relative to the first conductive terminal member 31. The force may be applied by, for example, inserting a screw driver or other instrument through the first wire release opening 35 to push the first spring clip 33 away from the first lead wire. In some cases, the first wire release opening 35 may extend through the housing 10 at an angle relative to the bottom side of the first housing projection 27 of the housing 10. For example, the angle may be between 30 degrees and 90 degrees, such as, for example, 45 degrees or 60 degrees. However, it is contemplated that any suitable angle may be used, as desired.

The first spring clip 33 may help secure an end of a first lead wire relative to the first conductive terminal member 31 when the end of the first lead wire is pushed through the first wire receiving opening 34 of the housing 10 and sufficiently far through the hole in the interconnecting portion of the U-shaped first end of the first conductive terminal member 31. In essence, this illustrative connector is a push-in connector that secures the end of a first lead wire to the terminal by pushing the wire lead sufficiently into the first wire receiving opening 34.

Similar to that described above, the normally open terminal 40 can include a second conductive terminal member 41. The second conductive terminal member 41 may be electrically coupled to a second stationary contact 73. In some cases, the second conductive terminal member 41 can extend at least from the second stationary contact 73 to a second cavity 46 inside the housing 10. In the illustrative embodiment, the end of the second conductive terminal member 41 extending into the second cavity 46 may be generally U-shaped. In some cases, the U-shaped end of the second conductive terminal member 41 may have two substantially parallel extending portions with an interconnecting portion extending between the two substantially parallel extending portions.

In some cases, the normally open terminal 40 can include a second spring clip 43. In some cases, the second spring clip 43 may be situated in or adjacent to the U-shaped end of the second conductive terminal member 41. In some cases, a clip mounting mechanism 42 can be provided to secure the second spring clip 43 relative to the second conductive terminal member 41. In some cases, the clip mounting mechanism 42 may be part of the housing 10. However, it is contemplated that any suitable method of securing the second spring clip 43 relative to the second conductive terminal member 41 may be used, as desired.

The second wire receiving opening 44 discussed above may extend through the housing 10 and into the second cavity 46. The second wire receiving opening 44 can be sized to receive an end of a second lead wire for connection to the second conductive terminal member 41. In some cases, the second wire receiving opening 44 may have a depth of at least 0.10 inches or at least 0.25 inches. However, it is contemplated that any suitable depth may be used, as desired. The depth of the second wire receiving opening 44 may help determine the insulative characteristics of the housing in or around the second wire receiving opening 44.

In some cases, at least one of the two substantially parallel extending portions of the second conductive terminal member 41 may include a second wire release opening, and the housing 10 may include a corresponding second wire release opening 45 for allowing a force to be applied to the second spring clip 43 to release the end of the second lead wire relative to the second conductive terminal member 41. The force may be applied by, for example, inserting a screw driver or other instrument through the second wire release opening 45 to push the second spring clip 43 away from the second lead wire. In some cases, the second wire release opening 45 may extend through the housing 10 at an angle relative to the bottom side of the housing 10. For example, the angle may be between 30 degrees and 90 degrees, such as, for example, 45 degrees or 60 degrees. However, it is contemplated that any suitable angle may be used, as desired.

The second spring clip 43 may help secure an end of a second lead wire relative to the second conductive terminal member 41 when the end of the second lead wire is pushed through the second wire receiving opening 44 of the housing 10 and sufficiently far through the hole in the interconnecting portion of the U-shaped end of the second conductive terminal member 41. In essence, this illustrative connector is a push-in connector that secures the end of a second lead wire to the terminal by pushing the wire lead sufficiently into the second wire receiving opening 44.

Similar to that described above, the illustrative common terminal 50 may include a third conductive terminal member 51. The third conductive terminal member 51 may be electrically coupled to a movable contact 70. In some cases, the third conductive terminal member 51 can extend at least from the movable contact 70 to a third cavity 56 inside the housing 10. In one illustrative example, the end of the third conductive terminal member 51 extending into the third cavity 56 may be generally U-shaped, as shown. In some cases, the U-shaped end of the third conductive terminal member 51 may have two substantially parallel extending portions with an interconnecting portion extending between the two substantially parallel extending portions.

In the illustrative embodiment shown, the common terminal 50 may include a third spring clip 53. In some cases, the third spring clip 53 may be situated in or adjacent to the U-shaped first end of the third conductive terminal member 51. Like above, a clip mounting mechanism 52 can be provided to secure the spring clip 53 relative to the third conductive terminal member 51. In some cases, the clip mounting mechanism 52 may be part of the housing 10. However, it is contemplated that any suitable method of securing the third spring clip 53 relative to the third conductive terminal member 51 may be used, as desired.

The third wire receiving opening 54 discussed above may extend through the housing 10 and into the third cavity 56. The third wire receiving opening 54 can be sized to receive an end of a third lead wire for connection to the third conductive terminal member 51. In some cases, the third wire receiving opening 54 may have a depth of at least 0.10 inches or at least 0.25 inches. However, it is contemplated that any suitable depth may be used, as desired. The depth of the third wire receiving opening 54 may help determine the insulative characteristics of the housing in or around the third wire receiving opening 54.

In some cases, at least one of the two substantially parallel extending portions of the third conductive terminal member 51 may include a third wire release opening, and the housing 10 may include a corresponding third wire release opening 55 for allowing a force to be applied to the third spring clip 53 to release the end of the third lead wire relative to the third conductive terminal member 51. The force may be applied by, for example, inserting a screw driver or other instrument through the third wire release opening 55 to push the third spring clip 53 away from the third lead wire. In some cases, the third wire release opening 55 may extend through the housing 10 at an angle relative to the right side of the second housing projection 29 of the housing 10. For example, the angle may be between 30 degrees and 90 degrees, such as, for example, 45 degrees or 60 degrees. However, it is contemplated that any suitable angle may be used, as desired.

The third spring clip 53 may help secure an end of a third lead wire relative to the third conductive terminal member 51 when the end of the third lead wire is pushed through the third wire receiving opening 54 of the housing 10 and sufficiently far through the hole in the interconnecting portion of the U-shaped end of the third conductive terminal member 51. In essence, this illustrative connector is a push-in connector that secures the end of a third lead wire to the terminal by pushing the wire lead sufficiently into the third wire receiving opening 54.

This illustrative microswitch 1 of FIG. 1 may include a switching mechanism that includes a snap-spring assembly, such as snap-spring assembly 60, to actuate the movable contact 71 between the first stationary contact 72 and the second stationary contact 73 (i.e. between the normally closed terminal 30 and the normally open terminal 40). In the illustrative embodiment, the snap-spring assembly 60 includes an actuator arm 61 having a first end 63 and a second end 62, and a spring 64 having a first end 66 and a second end 65. The actuator arm 61 has the movable contact 70 at the second end 62. The movable contact 70 may be positioned to have a first side that can be in contact with the normally closed first stationary contact 72 and a second side that can be in contact with the normally open second stationary contact 73, but not at the same time.

The spring 64 may have a first end 66 attached to a stationary anchor 67. The second end 65 of the spring 64 is attached to the second end 62 of the actuator arm 61 adjacent the movable contact 70. The spring 64 may be axially compressed and bent to extend from the first end 66, which may be attached to the stationary anchor 67 below the actuation arm 61, up through the actuation arm 61 and then bent again to extend back to, or in some cases, through, the actuation arm 61 to the second end 62 and attached to the actuation arm 61.

In the illustrative embodiment, the snap-spring assembly 60, when attached to the stationary anchor 67, forms a snap-spring-anchor assembly. In one example, the stationary anchor 67 may extend up through at least a portion of the actuation arm 61 allowing the actuator arm 61 to move vertically relative to the stationary anchor 67, but may restrict movement of the actuator arm 61 in the horizontal direction.

A plunger, such as plunger 20, may have a first end 21 extending out of the housing 10 and a second end 22 in contact with the actuation arm 61. Under some conditions, the second end 22 of the plunger 20 may exert an actuation force on the actuator arm 61 of the snap-spring assembly 60.

In operation, the central spring member 64 of the snap-spring-anchor assembly may be loaded into an axial compression and persuaded to bend to form a switch apparatus in which the movable contact 70 is responsive to an actuating force derived from the plunger 20 via the snap-spring assembly 60 to move the movable contact 70 between making electrical contact with the normally closed first stationary contact 72 and making electrical contact with the normally open second stationary contact 73. The actuating force derived from the plunger 20 may cause the first end 63 of the actuation arm 61 to move downward increasing the compression of the spring 64. When the compression force of the spring 64 is great enough, the spring 64 may exert a force on the second end of the actuation arm 61, snapping the movable contact 70 from the normally closed first stationary contact 72 to the normally open second stationary contact 73. When the plunger 20 is released, the first end 63 of the actuation arm 61 moves upward, decreasing the compression of the spring 64. When the compression force of the spring 64 is low enough, the spring 64 may exert a force on the second end of the actuation arm 61, snapping the movable contact 70 from the normally open second stationary contact 73 to the normally closed first stationary contact 72.

In the illustrative embodiment, a bias member 23 having a first end 24 and a second end 25 may be provided to bias the plunger 20 in the upward position. The first end 24 of the bias member 23 may engage the actuator arm 61, and the second end 25 may be attached to the stationary anchor 67. When the actuation force derived from the plunger 20 is sufficiently strong, the bias force of the bias member 23 may be overcome, thereby actuating the actuator arm 61 as described above. When the actuation force derived from the plunger 20 is sufficiently decreased, the bias member 23 may move the actuator arm 61 and the plunger up sufficiently far to snap the switch back to the normally closed position.

With the plunger 20 in the completely released or free state, the movable contact 70 is in contact with the normally closed first stationary contact 72, as shown. In this condition, the normally closed terminal 30 is in electrical continuity with the common terminal 50, via the actuation arm 61 and/or the spring 64, and the stationary anchor 67. In this embodiment, the stationary anchor 67 is part of, or electrically coupled to, the third conductive terminal member 51.

As the plunger 20 is depressed with a force sufficient to overcome the bias member 23, it reaches an operating point, at which, without further movement of the plunger 20, the snap-spring assembly 60 snaps the movable contact 70 into engagement with the normally open second stationary contact 73. In this condition, the normally open terminal 40 is in electrical continuity with the common terminal 50, via the actuation arm 61 and/or the spring 64, and the stationary anchor 67. In some cases, the snap-action may be nearly instantaneously, or, in other cases, the snap-action may take a few milliseconds or more.

In many cases, the microswitch I may exhibits hysteresis when snapping back and forth between the normally closed first stationary contact 72 and the normally open second stationary contact 73. In other words, a small reversal of the plunger 20 may be insufficient to reverse the snap-spring assembly 60, and instead, there must be more significant movement in the opposite direction to reverse the the snap-spring assembly 60. This may be desirable in some applications.

Figure 3:
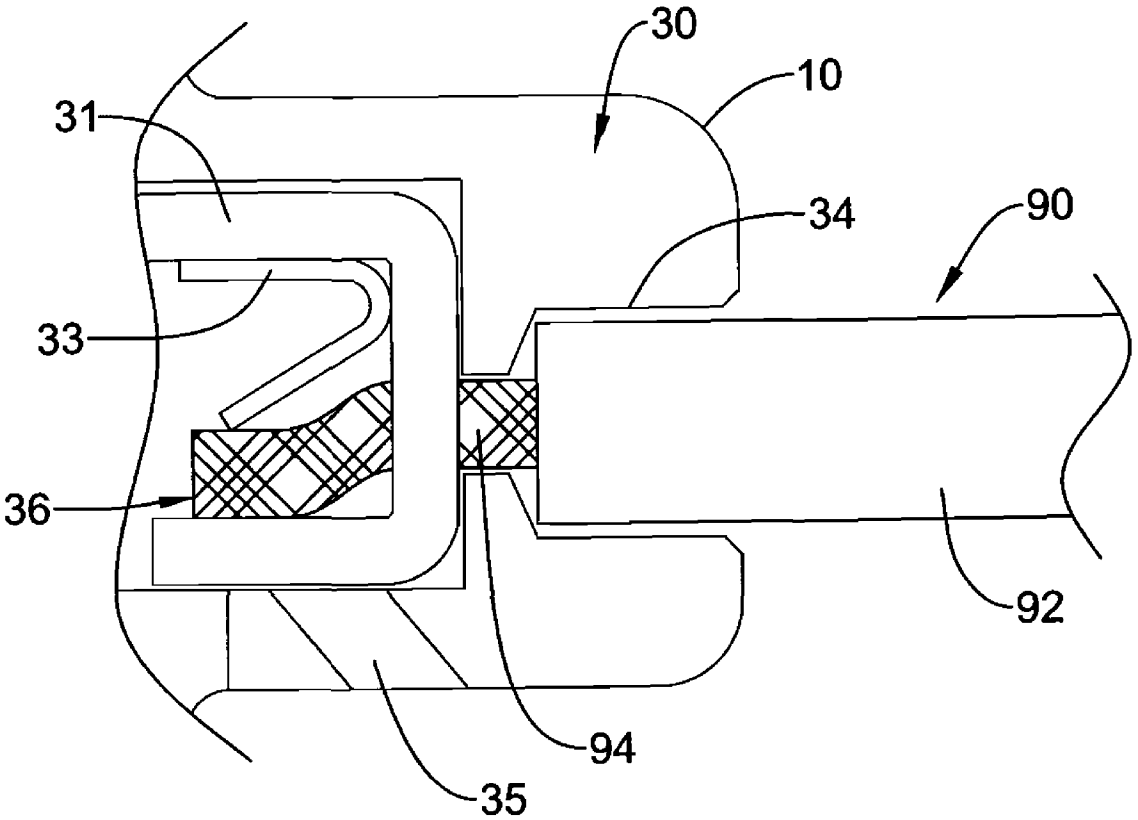
FIG. 3 is a partial cross-section head on view of the right most push-in wire connector of the microswitch of FIG. 1, with a lead wire inserted.

FIG. 3 is a partial cross-section head on view of the right most push-in wire connector of the microswitch of FIG. 1, with a lead wire 90 inserted. It will be understood that both the common terminal 50 and the normally open terminal 40 may include similar push-in connectors that operate in a similar manner.

In FIG. 3, the lead wire 90 has an end portion of the insulating outer layer 92, which is commonly found on electrical wires, removed to expose the conductive core 94. The lead wire 90 may then be inserted into the wire receiving opening 34, which can be sized to receive the lead wire 90 including the insulating outer layer 92. In some cases, the insulating outer layer 92 may pass into at least a portion of the housing 10, and the exposed conductive core 94 may extend further and into the first cavity 36, as illustrated. In other cases, however, the insulating outer layer 92 may not extend into the housing 10, but instead, the insulating outer layer 92 may abut the housing 10. Still, other cases, it is contemplated that the insulating outer layer 92 may be spaced a short distance from housing 10, if desired. In any case, the conductive core 94 may enter the first cavity 36 within the housing 10 via an opening in the conductive terminal member 31 and may engage the first spring clip 33. As the conductive core 94 of the lead wire 90 engages the spring clip 33, the spring clip 33 bends as shown, thereby locking the lead wire 90 in place.

The illustrative connection may help to simplify the connection of lead wires to the microswitch. During assembly, the lead wire 90 only needs to be stripped to expose the conductive core 94, and then pushed into the opening provided in the housing 10. The lead wire 90 is locked in place, thereby providing a reliable connection. Also, because the insulating outer layer 92 may extend into a counterbore in the housing, sometimes for a substantial distance, no additional insulating steps such as the use of insulative paper may need to be performed to properly insulate the connection. This may help reduce the assembly time and cost associated with the assembling a device incorporating the illustrative microswitch 1.

Figure 4:
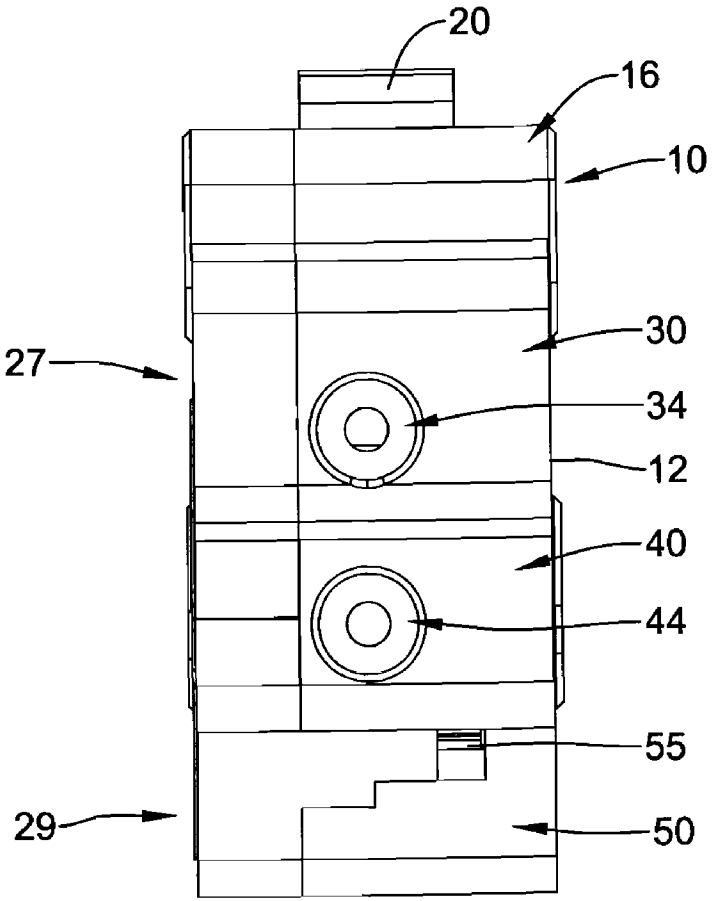
FIG. 4 is a right side view of the illustrative microswitch of FIG. 1.

FIG. 4 is a right side view of the illustrative microswitch of FIG. 1. The illustrative right side 16 extends between the front side 11 and the back side 12 of the microswitch 1. In some cases, the right side 16 may have a width of 1 inch or less, or 0.5 inches or less. However, it is contemplated that the right side 16 of the housing 10 may have any suitable width, as desired. Additionally, the other sides 15, 17, and 18 of the microswitch 1 may have similar widths, as desired.

The illustrative right side 16 view shows the first wire receiving opening 34 extending into the first housing projection 27 of the housing 10 for the normally closed terminal 30, and the third wire receiving opening 44 extending into the housing 10 for the normally open terminal 40. In the illustrative embodiment, the third wire receiving opening 44 may be situated between the first housing projection 27 and the bottom side 17 of the housing 10.

In some cases, the wire receiving openings 34 and 44 may have a counterbore having a counterbore diameter and counterbore depth configured to receive a wire. In some cases, the counterbore depth may be 1 inch or less. In one particular case, the counterbore depth may be 0.25 inches or less. Additionally, and in some cases, the counterbore diameter may be 0.05 inches or more. In one particular case, the counterbore diameter may be 0.105 inches or more. However, it is contemplated that any suitable counterbore depth and counterbore diameter may be used, depending on the wire.

As detailed with respect to FIG. 3, a lead wire 90 may be inserted into the wire receiving openings 34 and 44. The counterbore depth and counterbore diameter may be sized to accommodate the lead wire 90 including the insulating outer layer 92. In some cases, the exposed conductive core 94 of the lead wire may extend through the counterbore and into the first cavity 36 within the housing.

FIG. 4 also shows the wire release slot 55 in the second housing projection 29. In some cases, the wire release slot 55 may be generally rectangular. However, it is contemplated that any suitable shape may be used, as desired. The wire release slot 55 may be sized to accommodate a wire release tool such as a screw driver or the like. In some cases, as discussed herein, the wire release slots 35 and 45 may be angled, but this is not required in all embodiments.

Figure 5:
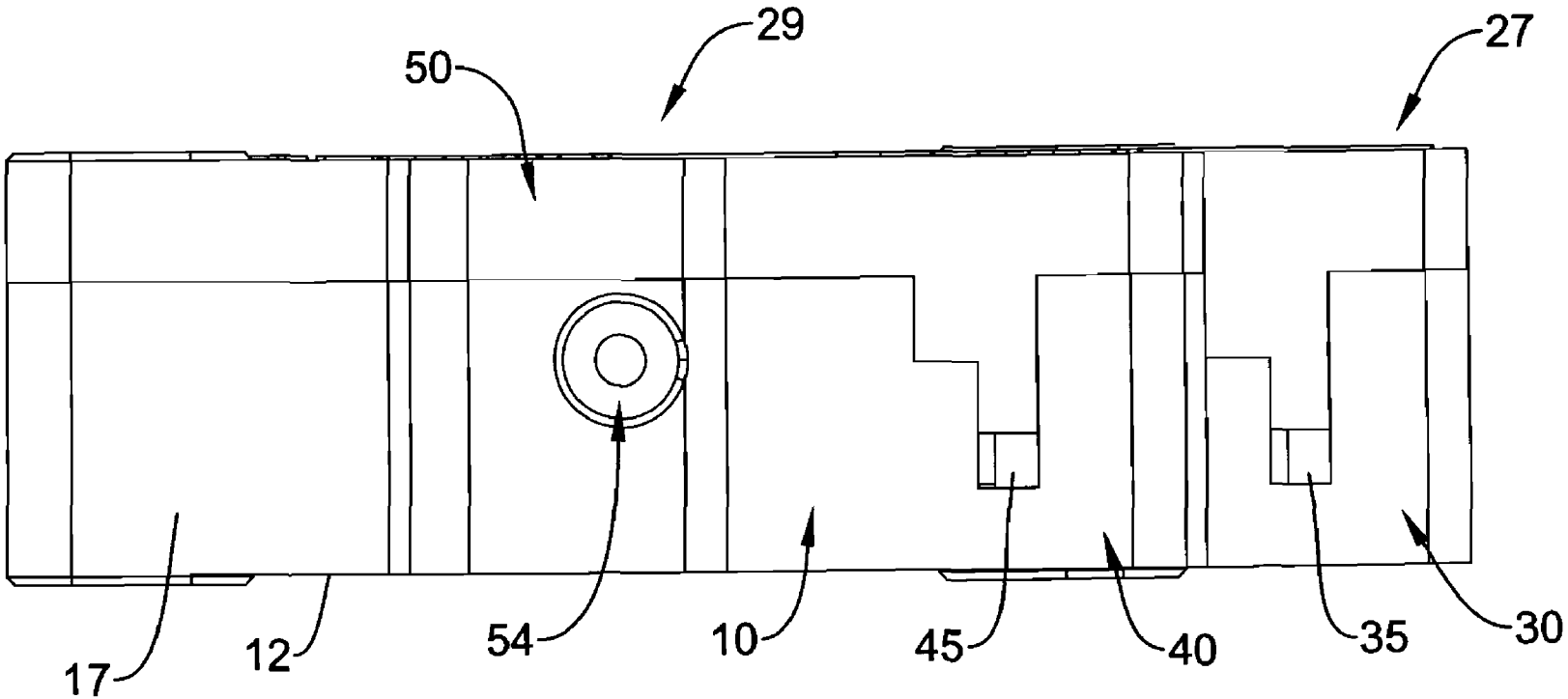
FIG. 5 is a bottom side view of the illustrative microswitch of FIG. 1.

FIG. 5 is a bottom side view of the illustrative microswitch of FIG. 1. The illustrative bottom side view shows the bottom side 17 of the microswitch 1, including the second housing projection 29 that defines the common terminal 50 of the illustrative microswitch 1. The illustrative second housing projection 29 may include a wire receiving opening 54, as shown. In some cases, the wire receiving opening 54 may be generally circular and have a counterbore having a counterbore diameter and counterbore depth to receive a lead wire. The counterbore for the wire receiving opening 54 may be similar to the wire receiving openings 34 and 44 discussed above. FIG. 5 also illustrates the normally open terminal 40 release slot 45 and the normally closed terminal 30 release slot 35. In some embodiments, and as discussed above, the release slots 35 and 45 may be angled, but this is not required in all embodiments.

To release one of the wires from the microswitch 1, a release tool, which is sized to fit in the release slot, may be inserted into the release slot. An inward force may be applied to the corresponding spring clip via the release tool to bend the spring clip away from the lead wire end. At the same time, the lead wire may then be pulled from the microswitch housing.

Figure 6:
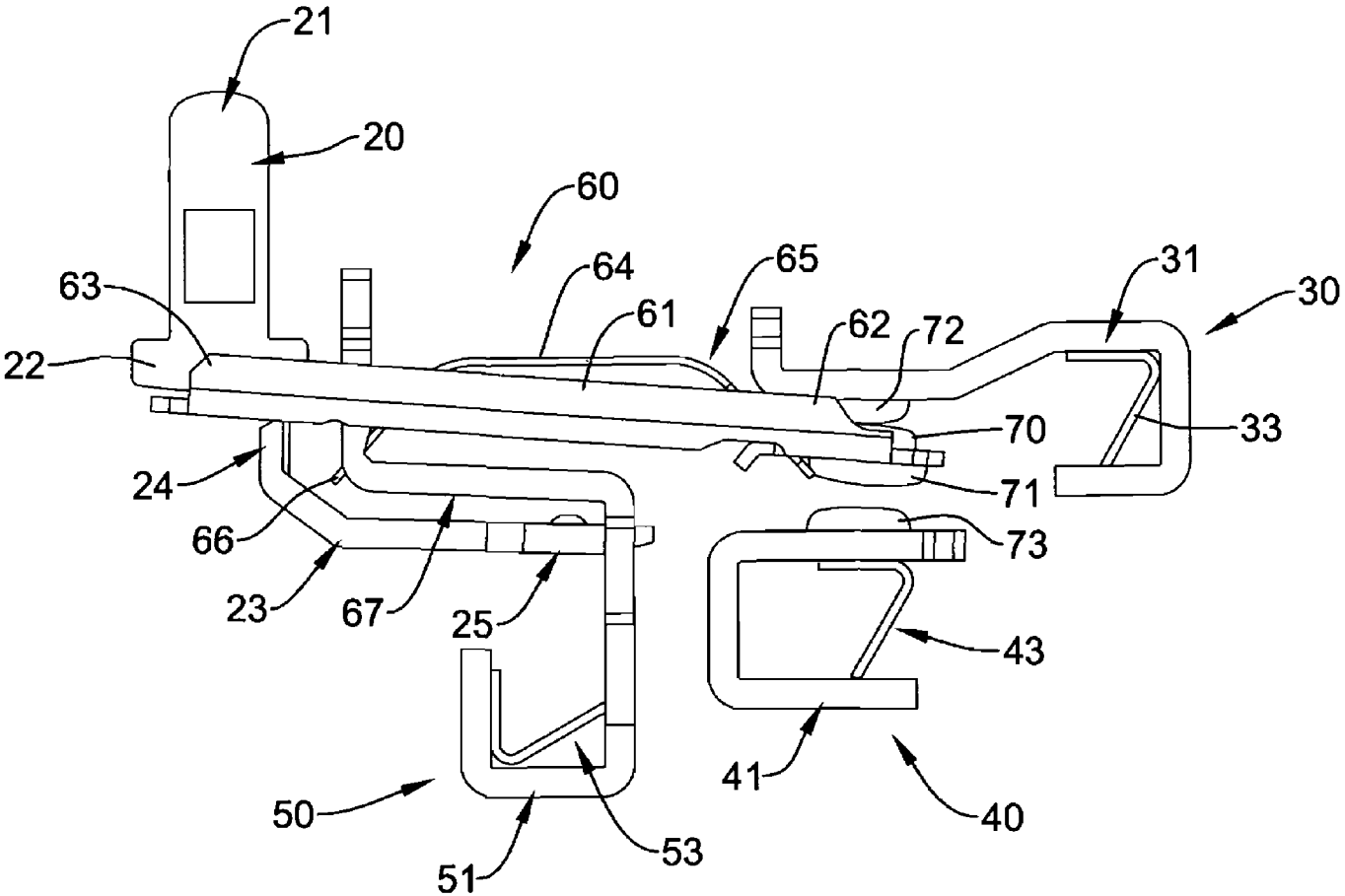
FIG. 6 is a free body diagram of the inner components of the illustrative microswitch of FIG. 1, with the housing removed.

FIG. 6 is a free body diagram of the inner components of the illustrative microswitch of FIG. 1, with the housing removed. In the illustrative embodiment, the switch components are shown in the normally closed position, with no actuation force applied to the plunger 20. In this state, the bias member 23 biases the snap-spring assembly 60 in contact with the normally closed contact 72, and an electrical current may flow between the common terminal 50 and the normally closed terminal 30.

As the plunger 20 is depressed downward with an actuation force, the bias member 23 is overcome, eventually reaching the switching point of the microswitch 1. At the switching point of the microswitch 1, the snap-spring assembly 60 snaps the movable contact 70 from the normally closed contact 72 to the normally open contact 73, and provides a biasing force against the normally open contact 73. In some cases, this snap-action may be nearly instantaneously, or it may take a few milliseconds or more. In this state, the bias member 23 biases the snap-spring assembly 60 in contact with the normally open contact 73, and an electrical current may flow between the common terminal 50 and the normally open terminal 40.

When force depressing the plunger 20 is removed, the snap-spring assembly 60 may snap the movable contact 70 back to the normally closed contact 72. In many cases, the microswitch 1 may exhibits hysteresis when snapping between the normally closed contact 72 and the normally open contact 73. As such, a small reversal of the plunger 20 may be insufficient to reverse the snap-spring assembly 60. Instead, and in some illustrative embodiments, there must be some minimum threshold movement of the plunger in the opposite direction before the snap-spring assembly 60 snaps back to the previous switch position.

Figure 7:
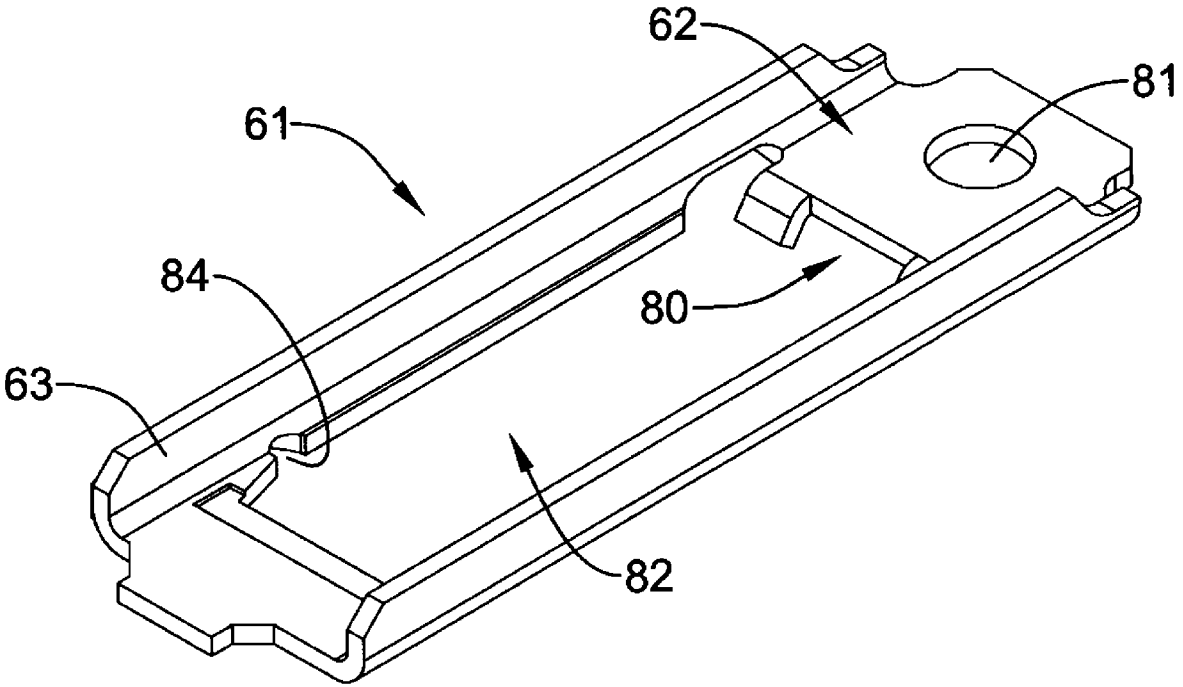
FIG. 7 is a perspective view of the actuation arm of the illustrative microswitch of FIG. 1.

FIG. 7 is a perspective view of the actuation arm of the illustrative microswitch of FIG. 1. In the illustrative embodiment, the actuation arm 61 may be a relatively rigid member, and in some cases, may be electrically conductive. As illustrated, the actuation arm 61 includes a central opening 82 and a smaller opening 81 near the second end 62. The larger central opening 82 may include one or more notches to hold the spring 64 and/or stationary anchor 67. The stationary anchor 67 may be inserted through the central opening 82 near the first end 63. In some cases, the stationary anchor 67 may slide into notches 84 of the opening 82 near the first end 63. In this configuration, the actuation arm 61 may be able to slide vertically along the stationary anchor 67.

In some cases, the spring 64 may span the longitudinal length of the central opening 82. In other cases, the second end of the spring 64 may be attached to the actuation arm 61 adjacent to notch 80 of the opening 82 near the second end 62 of the actuation arm 61. However, it is contemplated that the spring 64 may be attached to the actuation arm 61 at any suitable location, as desired.

In the illustrative embodiment, the generally circular smaller opening 81 may be sized to accommodate the movable contact 70/71 (see FIG. 6) disposed therein. The opening 81 may allow the movable contact 70/71 to extend to both sides of the actuation arm 61 so that it can contact both the normally open contact 73 and the normally closed contact 72.

Having thus described the preferred embodiments of the present invention, those of skill in the art will readily appreciate that yet other embodiments may be made and used within the scope of the claims hereto attached. Numerous advantages of the invention covered by this document have been set forth in the foregoing description. It will be understood, however, that this disclosure is, in many respect, only illustrative. Changes may be made in details, particularly in matters of shape, size, and arrangement of parts without exceeding the scope of the invention. The invention's scope is, of course, defined in the language in which the appended claims are expressed.

The invention claimed is:

1. A switch apparatus, comprising:

a housing having a first surface, a second surface opposing the first surface, and side surfaces extending between the first surface and the second surface, the side surfaces including a top side surface, a bottom side surface, a left side surface and a right side surface;

the housing, when viewed from the first surface, having a footprint that is generally rectangular in shape except for a first housing projection that extends out from the right side of the housing and a second housing projection that extends out from the bottom side of the housing, the first housing projection having a first wire receiving opening and the second housing projection having a second wire receiving opening; and a plunger extending from the top side surface of the housing.

2. The switch apparatus of claim 1 further comprising a third wire receiving opening extending through the right side surface of the housing.

3. The switch apparatus of claim 2 wherein the third wire receiving opening is situated between the first housing projection and the bottom side of the housing.

4. The switch apparatus of claim 1 wherein the first wire receiving opening, the second wire receiving opening and the third wire receiving opening include a counterbore with a counterbore diameter and a counterbore depth.

5. The switch apparatus of claim 4 wherein the counterbore depth is one-quarter of an inch or less.

6. The switch apparatus of claim 4 wherein the counterbore diameter is 0.105 inch or more.

7. The switch apparatus of claim 1, wherein the first housing projection has a right side, a top side and a bottom side, wherein the first wire receiving opening extends through the right side of the first housing projection.

8. The switch apparatus of claim 7, wherein the first housing projection further comprises a wire release opening extending through the bottom side of the first housing projection.

9. The switch apparatus of claim 1, wherein the second housing projection has a right side, a left side and a bottom side, wherein the second wire receiving opening extends through the bottom side of the second housing projection.

10. The switch apparatus of claim 9, wherein the second housing projection further comprises a second wire release opening extending through the right side of the second housing projection.

11. The switch apparatus of claim 1 further comprising:

a third wire receiving opening extending through the right side surface of the housing; and a third wire release opening extending through the bottom side surface of the housing.

12. The switch apparatus of claim 1 further comprising a first mounting hole extending through the housing between the first surface and the second surface, wherein the first mounting hole is located at a location that is in a bottom left quadrant of the housing.

13. The switch apparatus of claim 12 further comprising a second mounting hole extending through the housing between the first surface and the second surface, wherein the second mounting hole is located at a location that is in a top right quadrant of the housing.

14. The switch apparatus of claim 1 wherein the second housing projection is spaced inward from the right side surface and the left side surface of the housing.

15. The switch apparatus of claim 14 wherein the second housing projection extends out from at or near the center of the bottom side wall of the housing.

16. The switch apparatus of claim 1 wherein the generally rectangular in shape footprint of the housing, excluding the first housing projection and the second housing projection, is 1.2 inches or less by 0.66 inches or less.

17. The switch apparatus of claim 16 wherein the side surfaces extending between the first surface and the second surface of the housing have a length of 0.5 inches or less.

18. A switch apparatus, comprising:

a housing;

a plunger extending out from the housing;

a stationary anchor;

a first stationary contact and a second stationary contact, wherein the first stationary contact comprises a normally open contact and the second stationary contact comprises a normally closed contact;

a movable contact;

a snap-spring assembly reactive to said plunger, wherein said snap-spring assembly is coupled to said stationary anchor to form a snap-spring-anchor assembly having a central spring member loaded into an axial compression and persuaded to bend to form a switch apparatus in which said moveable contact is responsive to an actuating force derived from said plunger via the snap-spring assembly to move the movable contact between making electrical contact with the first stationary contact and making electrical contact with the second stationary contact;

a first conductive terminal member electrically coupled to the first stationary contact, the first conductive terminal member extending at least from the first stationary contact to a first cavity inside the housing, wherein the first cavity has a first hole extending out through the housing that is adapted to receive an end of a first wire lead for connection to the first conductive terminal member, the first conductive terminal member not extending outside of the housing;

a second conductive terminal member electrically coupled to the second stationary contact, the second conductive terminal member extending at least from the second stationary contact to a second cavity inside the housing, wherein the second cavity has a second hole extending out through the housing that is adapted to receive an end of a second wire lead for connection to the second conductive terminal member, the second conductive terminal member not extending outside of the housing; and a third conductive terminal member electrically coupled to the movable contact, the third conductive terminal member extending to a third cavity inside the housing, wherein the third cavity has a third hole extending out through the housing that is adapted to receive an end of a third wire lead for connection to the third conductive terminal member, the third conductive terminal member not extending outside of the housing.

19. The switch apparatus of claim 18 wherein the first conductive terminal member has a first end situated in the first cavity of the housing, the first end having a general U-shape.

20. The switch apparatus of claim 19 wherein the U-shaped first end of the first conductive terminal member has two substantially parallel extending portions with an interconnecting portion extending between the two substantially parallel extending portions, wherein the interconnecting portion includes a hole at least part of which is aligned or substantially aligned with the first hole that extends through the housing.

21. The switch apparatus of claim 20 further comprising a first spring clip situated in the U-shaped first end of the first conductive terminal member for securing the end of the first wire lead relative to the first conductive terminal member when the end of the first wire lead is pushed through the first hole of the housing and sufficiently far through the hole in the interconnecting portion of the U-shaped first end of the first conductive terminal member.

22. The switch apparatus of claim 21 wherein at least one of the two substantially parallel extending portions of the first conductive terminal member includes a first wire release opening, and the housing includes a corresponding first wire release opening for allowing a force to be applied to the first spring clip to release the end of the first wire lead relative to the first conductive terminal member.

23. The switch apparatus of claim 18 wherein the second conductive terminal member has a first end situated in the second cavity of the housing, the first end having a general U-shape.

24. The switch apparatus of claim 23 wherein the U-shaped first end of the second conductive terminal member has two substantially parallel extending portions with an interconnecting portion at one end of the two substantially parallel extending portions and an opposite open end, wherein the second hole that extends through the housing is aligned or substantially aligned with at least part of the open end of the U-shaped first end of the second conductive terminal member.

25. The switch apparatus of claim 24 further comprising a second spring clip situated in the U-shaped first end of the second conductive terminal member for securing the end of the second wire lead relative to the second conductive terminal member when the end of the second wire lead is pushed through the second hole of the housing and sufficiently far into the open end of the U-shaped first end of the second conductive terminal member.

26. The switch apparatus of claim 25 wherein at least one of the two substantially parallel extending portions of the second conductive terminal member includes a second wire release opening, and the housing includes a corresponding second wire release opening for allowing a force to be applied to the second spring clip to release the end of the second wire lead relative to the second conductive terminal member.

27. The switch apparatus of claim 18 wherein the third conductive terminal member has a first end situated in the third cavity of the housing, the first end having a general U-shape.

28. The switch apparatus of claim 27 wherein the U-shaped first end of the third conductive terminal member has two substantially parallel extending portions with an interconnecting portion extending between the two substantially parallel extending portions, wherein the interconnecting portion includes a hole at least part of which is aligned or substantially aligned with the third hole that extends through the housing.

29. The switch apparatus of claim 28 further comprising a third spring clip situated in the U-shaped first end of the third conductive terminal member for securing the end of the third wire lead relative to the third conductive terminal member when the end of the third wire lead is pushed through the third hole of the housing and sufficiently far through the hole in the interconnecting portion of the U-shaped first end of the third conductive terminal member.

30. The switch apparatus of claim 29 wherein at least one of the two substantially parallel extending portions of the third conductive terminal member includes a third wire release opening, and the housing includes a corresponding third wire release opening for allowing a force to be applied to the third spring clip to release the end of the third wire lead relative to the third conductive terminal member.

31. The switch apparatus of claim 18 wherein the third conductive terminal and the stationary anchor are integrally formed.

32. A snap-acting switch apparatus, comprising:

a housing;

a plunger for activating the switch;

a stationary anchor;

a first stationary contact and a second stationary contact, wherein the first stationary contact comprises a normally open contact and the second stationary contact comprises a normally closed contact;

a movable contact;

a snap-spring assembly reactive to said plunger, wherein said snap-spring assembly is coupled to said stationary anchor to form a snap-spring-anchor assembly to form a switch apparatus in which, after the plunger reaches an operating point, the snap-spring assembly snaps the movable contact between making electrical contact with the first stationary contact and making electrical contact with the second stationary contact without a commensurate movement of the plunger;

a first push-in wire connector for electrically connecting an end of a first wire to the first stationary contact, wherein the first push-in wire connector includes a first hole through the housing and a first spring clip within the first hole, wherein as the first wire is inserted into the first hole, the first wire resiliently bends the first spring clip back, and in this position, the first spring clip holds the first wire in electrical contact with the first stationary contact and prevents the first wire from being removed from the first hole;

a second push-in wire connector for electrically connecting an end of a second wire to the second stationary contact, wherein the second push-in wire connector includes a second hole through the housing and a second spring clip within the second hole, wherein as the second wire is inserted into the second hole, the second wire resiliently bends the second spring clip back, and in this position, the second spring clip holds the second wire in electrical contact with the second stationary contact and prevents the second wire from being removed from the second hole; and a third push-in wire connector for electrically connecting an end of a third wire to the movable contact, wherein the third push-in wire connector includes a third hole through the housing and a third spring clip within the third hole, wherein as the third wire is inserted into the third hole, the third wire resiliently bends the third spring clip back, and in this position, the third spring clip holds the third wire in electrical contact with the third stationary contact and prevents the third wire from being removed from the third hole.

* * * * *